United States Patent [19]

Bronnec

[11] 4,264,444

[45] Apr. 28, 1981

[54] APPARATUS FOR RECOVERING MATERIAL FLOATING ON A BODY OF WATER AND A BARGE FOR CARRYING SUCH APPARATUS

[75] Inventor: Jean A. L. Bronnec, Brest, France

[73] Assignee: Ateliers Generaux de Mecanique de l'Ouest, Brest, France

[21] Appl. No.: 52,327

[22] Filed: Jun. 26, 1979

[30] Foreign Application Priority Data

Jul. 4, 1978 [FR] France ..... 78 19943

[51] Int. Cl.[3] ..... E02B 15/04

[52] U.S. Cl. ..... 210/242.3; 210/923

[58] Field of Search ..... 210/83, 242 R, 242 S, 210/DIG 25

[56] References Cited

U.S. PATENT DOCUMENTS

| | | | |
|---|---|---|---|
| 3,219,190 | 11/1965 | Thune | 210/242 |
| 3,259,245 | 7/1966 | Earle | 210/242 |
| 3,700,108 | 10/1972 | Richards | 210/242 |
| 3,708,070 | 1/1973 | Bell | 210/242 |
| 3,715,034 | 2/1973 | Ilonoff | 210/242 |
| 4,033,869 | 7/1977 | McGrew | 210/65 |
| 4,033,876 | 7/1977 | Cocjin | 210/242 |

FOREIGN PATENT DOCUMENTS

| | | |
|---|---|---|
| 7138148 | 1/1973 | France . |
| 7405247 | 6/1974 | France . |

*Primary Examiner*—Theodore A. Granger
*Attorney, Agent, or Firm*—Sandler & Greenblum

[57] ABSTRACT

A pair of elongated arms are articulated on respective sides of a recovery opening mounted on a barge that carries a settling tank for collecting floating material. The draft of the barge is maintained essentially constant during loading of material ingested through the recovery opening and discharged into the tank whereby the depth of immersion of the recovery opening remains substantially constant. The articulation of the arms is such that they can move in a horizontal direction sweep floating material into the recovery opening. Nozzles may be provided on the arms for creating currents that urge floating material swept by the arms into the recovery opening.

1 Claim, 10 Drawing Figures

APPARATUS FOR RECOVERING MATERIAL FLOATING ON A BODY OF WATER AND A BARGE FOR CARRYING SUCH APPARATUS

BACKGROUND OF THE INVENTION

This invention relates to apparatus for recovering materials floating on a body of water, and to a barge for carrying such apparatus.

1. Field of the Invention

Apparatus of the type described is useful in collecting floating material that would otherwise pollute a body of water.

2. Description of the Prior Art

Known apparatus of the type described include suction equipment, bucket-conveyors, paddle pumps, etc. Each of these devices includes a recovery opening which is slightly submerged and connected to an elevator conveyor for carrying the collected material to an evacuation drain from which the materials can be emptied into a settling or storage tank carried by a barge. In order to permit operation near shore, the barge must have a shallow draft.

In order to function best, apparatus for recovering floating material should create a current which tends to draw the floating material towards the recovery opening whose depth of submersion should vary only sightly around a predetermined optimum value during the entire time that the settling tank in a barge is being loaded with the floating material. It is therefore an object of the present invention to provide a new and improved apparatus for recovering floating material and a barge carrying the same which functions in the manner described above.

SUMMARY OF THE INVENTION

In accordance with the present invention, a pair of elongated arms are articulated on respective sides of a recovery opening mounted on a barge that carries a settling tank for collecting the floating material. Means are provided for maintaining the draft of the barge essentially constant during loading of floating material ingested through the recovery opening and discharged into the settling tank whereby the depth of immersion of the recovery opening remains substantially constant. The process commences by filling the tank with water up to the highest level compatible with the draft of the barge then adjusting the position of the recovery opening so that it is submerged to optimum depth. The draft is maintained substantially constant by discharging quantities of water from the settling tank corresponding to the weight of material entering the recovery opening and discharged into the settling tank.

In one embodiment of the invention, a drain hole is provided in the tank and in the barge below the water line, and a selectively operable obturator cooperates with the drain hole for controlling the connection between the tank and the water on which the barge floats.

In another embodiment of the invention, a vertical overflow pipe is mounted in the tank open at the bottom end thereof. The top of the overflow pipe defines the initial water level in the tank and a discharge pipe connected to the top of the overflow pipe provides a conduit for water from the tank to the exterior of the barge in response to the collection of material in the barge. Preferably, the discharge pipe is telescopically mounted on the overflow pipe for regulating the level of its discharge orifice as a function of the initial water level in the tank. Instead of telescopic elements, flexible piping can be provided on at least a part of the length of the discharge pipe.

According to the present invention, apparatus for recovering material floating on a body of water comprises a pair of elongated sweeping arms each mounted for pivotal movement about vertical and horizontal axes located on opposite sides of the recovery opening, and a float mounted on the free end of each arm for enabling the sweeping arms to float on the surface of the water. Pivotal movement imparted to the sweeping arms about their vertical axes permit horizontal sweeping of the surface of the water adjacent to the recovery opening thereby sweeping floating material into alignment with such opening. By providing operating arms pivotably connected to the elongated sweeping arms, an operator may impart "sculling" movement to the arms on each side of the recovery opening so as to create a current which tends to draw floating material toward the recovery opening. In order to increase the "sweep" effect of the floating layer toward the opening, it is advantageous to arrange one or more nozzles on the arms for producing a jet directed along the length of the arm towards its vertical pivotal axis whereby floating material swept by the arm is urged toward the recovery opening. The nozzles may be fed by pressurized water piped, for example, from a pump utilizing the water on which the barge floats. Alternatively, a mechanical control of the arms from a power motor can be supplied provided that an intermittence sweeping movement of the arms is established, and provided that this movement is executed slowly.

BRIEF DESCRIPTION OF THE DRAWINGS

Embodiments of the invention are described below by way of example and with reference to the accompanying drawings wherein.

DESCRIPTION OF THE PREFERRED EMBODIMENTS

Figure 1:
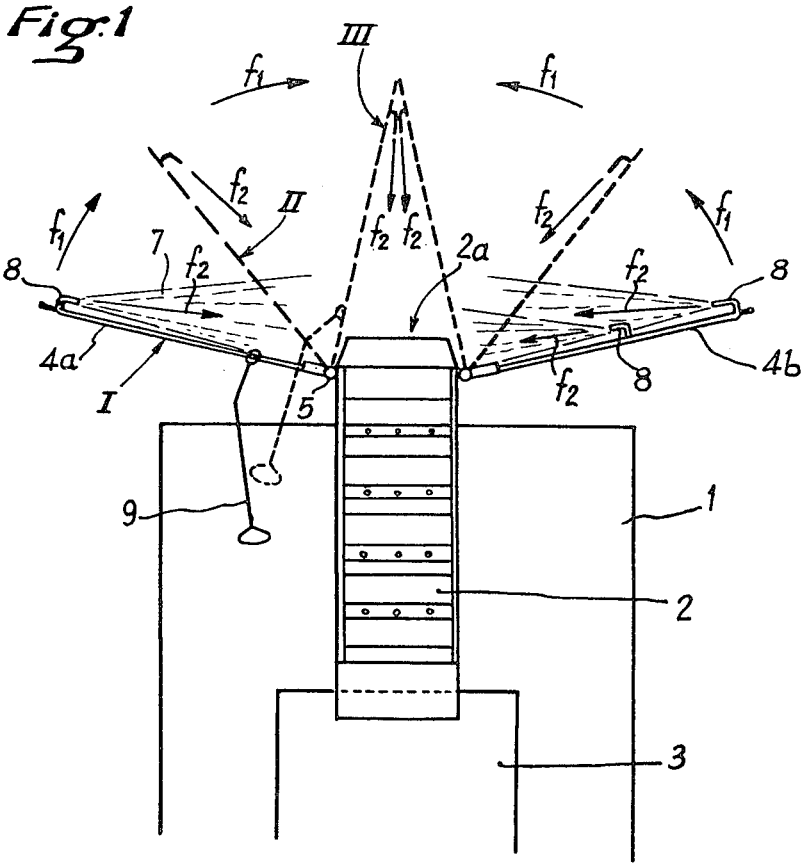
FIG. 1 is a top diagrammatic view of a barge equipped with a "sweep" device according to the present invention.
Figure 2:
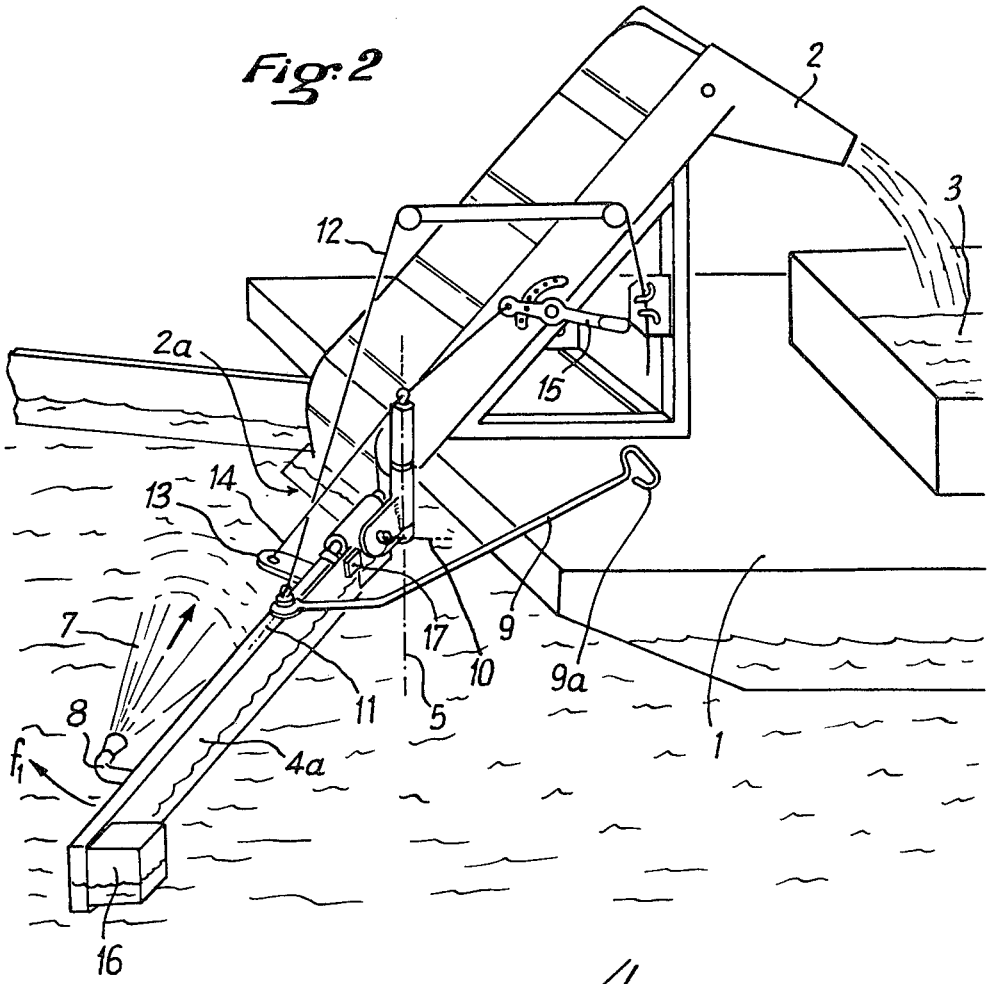
FIG. 2 is a larger scale perspective view of the manner in which a sweeping arm is articulated to the barge.
Figure 3:
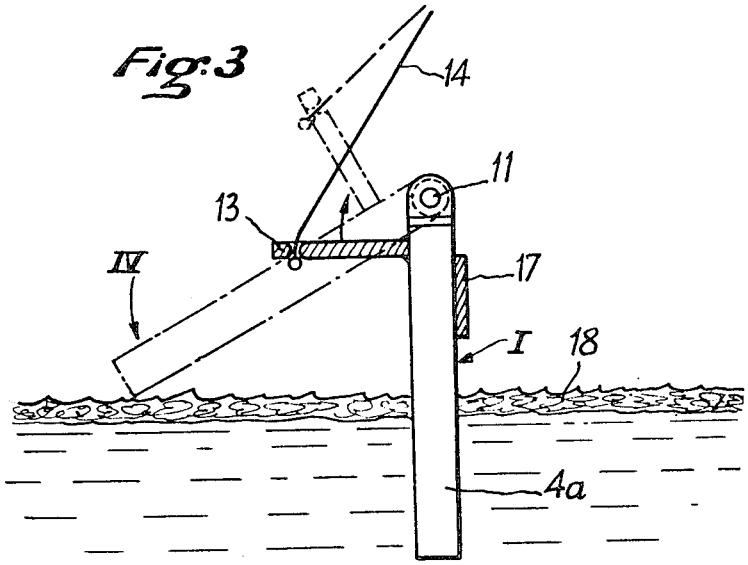
FIG. 3 is a still larger scale, end view of a sweeping arm taken along its swivel axis showing the manner in which it is rotated about its swivel axis to remove the arm from the water.

FIGS. 1 to 3 show barge 1 carrying apparatus 2 for recovering material floating on a body of water, the barge carrying a settling or storage tank 3 in which recovered material is deposited by the elevator conveyor of apparatus 2.

Recovery will be more rapid if a current is created tending to direct the layer of floating material toward recovery opening 2*a* at the input to the conveyor of apparatus 2. For this purpose, the barge is provided with two elongated sweep arms 4*a*, 4*b*, articulated respectively on each side of opening 2*a* on the body of the barge. Alternatively, and preferably, the arms can be articulated on apparatus 2, as shown in FIG. 2. The articulation of each of the arms can be achieved by a fixed point (swivel joint), but certain rotations must be limited by stops. Preferably, the articulation joint defines three, mutually perpendicular axes 5, 10, 11, of which sweep axis 5 is essentially vertical, as shown in FIG. 2, lifting axis 10 being essentially horizontal, and swivel axis 11 being in the direction of elongation of a sweep arm.

At a suitable distance from its articulation, each sweep arm has operating arms 9 pivotally connected thereto. Arm 9, whose free end 9*a* forms a handle, is directed obliquely upward from the sweep arm in such a manner that end 9*a* can be held by an operator on the barge permitting him to "scull" the arm if desired or necessary.

Initially, arms 4*a* and 4*b* are separated from each other, as shown in full lines in FIG. 1, position I. Each arm is slat-like; and in its normal angular position of the arm with respect to its swivel axis, the cross-section of the arm is vertical as in position I of FIG. 3. In such angular position, the arms can be pivoted toward each other, as indicated by arrows f1, around axis 5, utilizing actuating arms 9 and until their free ends engage in the median plane of the barge in position III, after passing through the intermediate position II (FIG. 1). This sweeping movement on the surface of the water tends to draw the floating materials into the axis of the barge. At the same time, these materials are pushed toward the opening 2*a* by water jets 7 produced by nozzles 8 on arms 4*a*, 4*b*. The water jets 7 are directed along the length of the sweeping arm and are preferably flattened in a horizontal plane so as to be directed toward recovery opening 2*a* at all positions of the sweeping arms, as indicated by f2. Each arm can have a nozzle 8 near its free end shown on arm 4*a* in FIG. 1, or a plurality of nozzles 8 as shown on arm 4*b*. All of the nozzles may be fed with pressurized water through flexible piping from a pump utilizing water on which the barge floats.

Each arm has a float 16 on its free end, on the surface of the arm turned toward the outside, as in FIG. 2. This allows the arm to "follow" surface movements of the water as the necessary pivotal movement of the arm around the axis 10 occurs. Float 16, being eccentric to swivel axis 11, also creates a torque which, as shown in FIG. 2, tends to rotate arm 4*a* around swivel axis 11 until the arm abuts stop 17 when the arm is in the vertical position shown in FIGS. 2 and 3.

When the sweeping movement is terminated, as in position III, FIG. 1, the arms must be returned to position I before the next sweeping operation can begin. To avoid pushing floating material outwardly from the front of the barge toward the rear during this return movement of the arms, they are removed from the water. A relatively lengthy operation would be involved in raising an arm around its axis 10, for example, by drawing on lifting cable 12, (which would also require arm 9 to be moved out of the way and that jets 7 be stopped). Such a maneuver is executed when the barge is floated, but is not desirable in the course of operating the barge. Instead, to remove an arm from the water in the course of work, it is swivelled around axis 11. Such an operation is shown in FIG. 3, wherein arm 4*a* passes through position I to position IV, shown in broken line. To realize this maneuver, it suffices to draw on cable 14 which extends between the end of handle 15 and the end of extension 13 fixed rigidly at a right angle on the inside surface of an arm. Leverage is obtained by pivoting handle 15, which can be carried out in a simple and rapid maneuver. The degree of swivelling of an arm must be sufficient to permit the arm to be raised above layer 18 of floating material. When both arms are swivelled, they can be moved from position III (FIG. 1) to position I after which each handle 15 is returned to its initial position as the arms are rotated about axis 11 and returned to their vertical positions in contact against abutments 17. Thus position I is regained, as shown in FIG. 1, in preparation for another sweep.

The operation of apparatus 2 depends upon the depth of submersion of recovery opening 2*a*. When the optimum depth is known, it is important to regulate the position of the apparatus accordingly, and to then avoid variations in the draft of the barge, to maintain this submersion level constant. Otherwise, constant vertical adjustment of opening 2*a* relative to the barge will be required.

Figure 7:
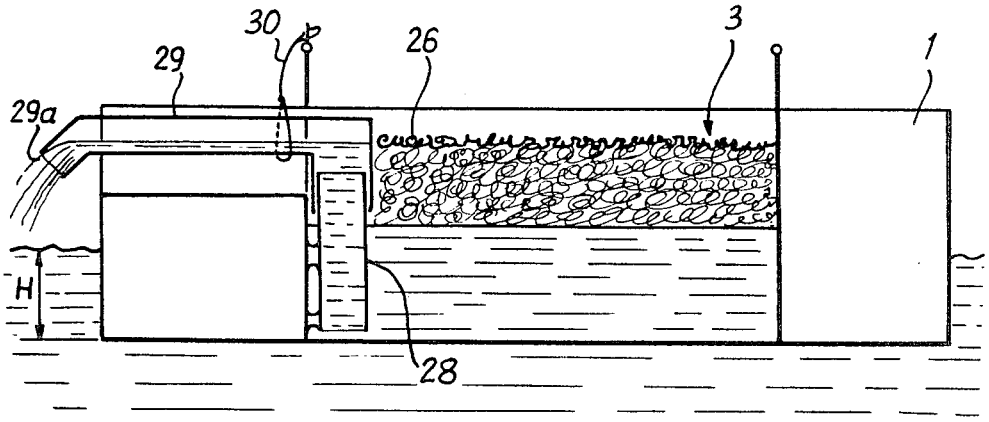
FIG. 7 is a tansverse cross section diagram of a barge having a flooded tank provided with automatic compensation by overflow.
Figure 4:
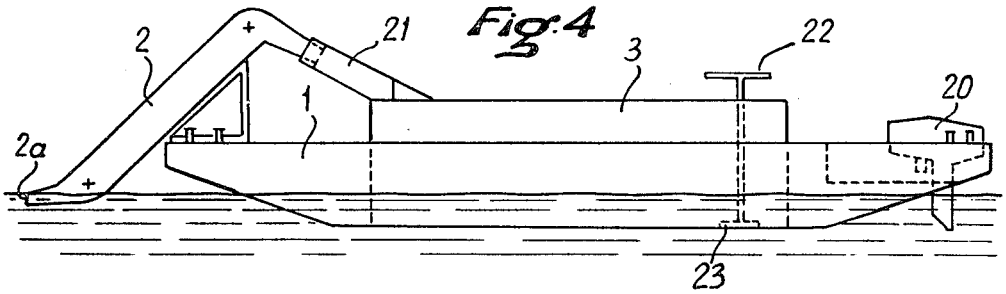
FIG. 4 is a diagrammatic elevation of a barge carrying a flooded settling tank, flooded at constant level, with manually regulated evacuation for maintaining the recovery opening at a substantially constant depth during loading of material in the settling tank.
Figure 5:
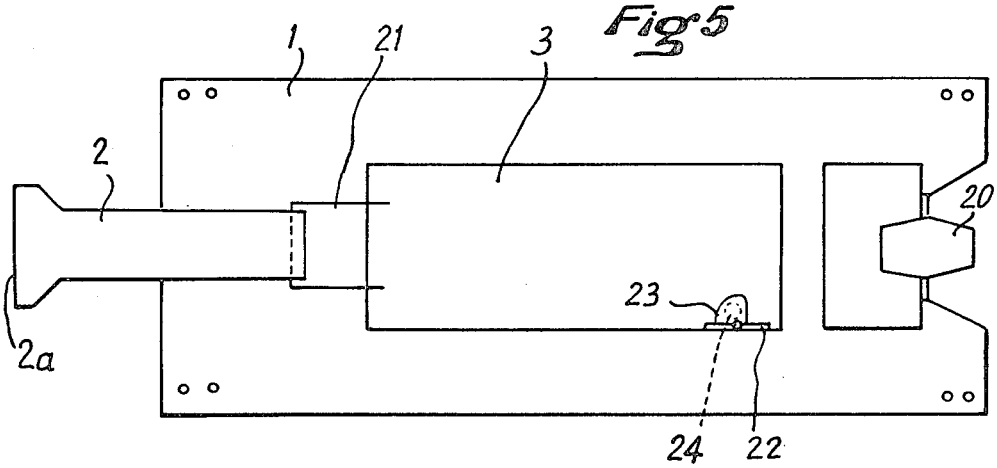
FIG. 5 is a planar view of the barge of FIG. 4.

Stabilization of the draft of the barge is obtained with the arrangements shown in FIGS. 4 and 7 wherein barge 1 is shown carrying apparatus 2 for recovery of floating materials, and a settling or storage tank 3. FIGS. 4 and 5 also show barge drive motor 20. As before, the floating material collected in opening 2*a* of apparatus 2 are transported by an elevator and then emptied into tank 3 through chute 21.

Tank 3 is a flooded tank, in other words filled with water at the beginning of the work process, and this water is discharged in proportion to the amount of water and floating material mixture entering the tank through chute 21. In order to maintain the draft of the barge at a constant value, designated by reference character H, the weight of the products emptied by drain 21 into the tank, and the water discharged from the tank must be kept equal. The density of the floating materials is close to but less than that of the water, and it is possible to flood tank 3 to a constant level when this compensation is obtained, but it cannot be done precisely.

The water can be evacuated manually, for example by use of a handwheel 22, actuating a flat obturator 23 located at the bottom of the tank and cooperable with discharge opening 24 in the barge below the water line.

Figure 6A:
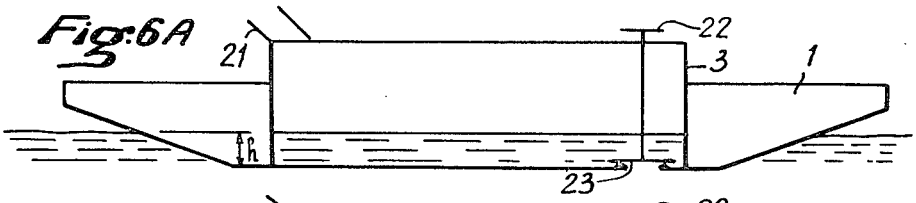
FIGS. 6A, 6B, 6C, 6D are schematic longitudinal cross sections of the barge of FIG. 4, respectively floating empty, beginning recovery of material (tank filled with water), in the course of recovering material, and when the settling tank is full.

The different phases of filling tank 3 are shown in FIGS. 6A to 6D. In FIG. 6A, the barge is empty, the draft is shallow, and tank 3 contains some water, which can be present due to the imperfect sealing of obturator 23. In this case, the maximum water level in the tank is h.

Figure 6B:
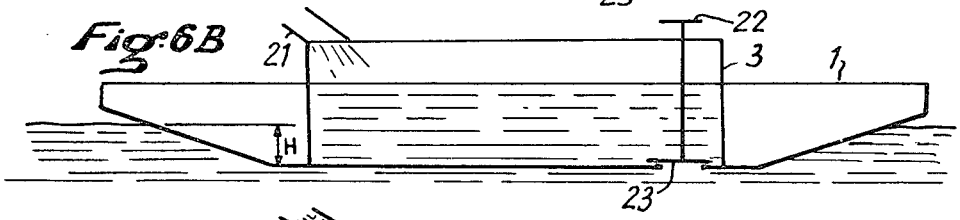

At the work site, FIG. 6B, the tank is filled with water until the barge has a suitable draft H, and recovery opening 2*a* is immersed to a controlled depth. Obturator 23 remains closed.

Figure 6C:
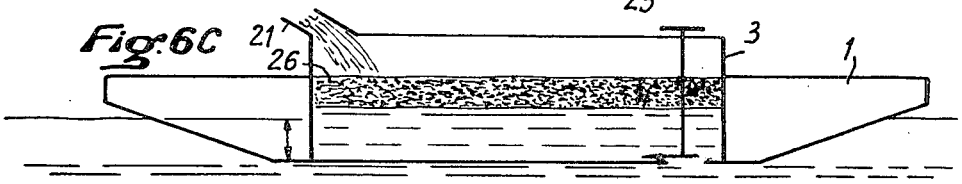

In FIG. 6C, the recovery work of floating material 26 has begun. Obturator 23 is open so as to partially disengage from orifice 24 and allow water in the tank to be discharged at a flow corresponding to that of the arrival of the water plus materials mixture through chute 21. The opening is regulated by trial and error and must be corrected intermittently to maintain draft H.

Figure 6D:
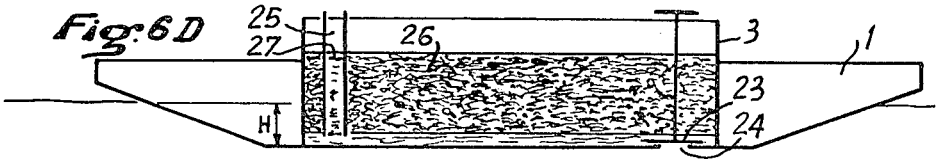

In FIG. 6D, tank 3 is essentially filled with recovered material. The operator is apprised of this by a vertical monitoring tube 25 whose top end is above maximum filling level of the tank and whose bottom end opens near the bottom end of the tank tube. When the recovered material reach the level of the bottom of the tube, material passes into the tube and float to the surface at 27 thereby signaling the operator that the tank is full. The operator then closes obturator 23.

Instead of using manually adjustable obturator 23, automatic compensation can be provided by means of vertical overflow tube 28, as shown in FIG. 7. Tube 28 opens near the bottom of tank 3 and has a discharge portion 29 at a right angle to the top of tube 28 so as to open on one side of the barge. Thus at any moment, an exact weight compensation is obtained between the water discharged through overflow orifice 29*a* and the recovered materials 26 emptied into the tank. With this weight compensation, the level of materials 26 in the tank is slightly above the water level in the overflow tube, and this level is the initial level of the water in the tank before the beginning of the recovery operation. As aforementioned, this initial water level depends on the draft H and it therefore can vary slightly. In FIG. 7, so that the level of the overflow orifice can be regulated as a function of said initial level, the angled discharge portion 29 is encased in a telescopic fashion and with a smooth fit on the vertical part 28. Line 30 or some other retaining or blocking means, holds portion 29 in the chose elevation position. In place of providing a telescopic part 29 for the overflow tube, it is possible to provide a flexible part, which also allows variation of the level of the evacuation orifice.

It is believed that the advantages and improved results furnished by the method and apparatus of the present invention are apparent from the foregoing description of the preferred embodiments of the invention. Various changes and modifications may be made without departing from the spirit and scope of the invention as described in the claims that follow.

What is claimed is:

1. A barge carrying apparatus for recovering materials floating on a body of water comprising: a pair of elongated sweeping arms, each of said arms pivotable about a vertical axis as well as a second distinct axis, said arms movably mounted on opposite sides of a recovery opening through which the materials are ingested, a float on the free end of each arm for enabling the arms to float on a water surface, means for pivotably mounting said arms about their vertical axes toward each other to sweep material into alignment with the opening and distinct means for moving said arms about said second axis so that said arms are moved out of contact with said water, a settling tank carried by the barge, means for maintaining the tank flooded to an essentially constant level comprising a vertical overflow pipe mounted in the tank and having an open bottom, the top of said pipe defining the initial water level of the tank, and a telescopically adjustable discharge pipe connected to said pipe top for conducting water from the tank to the exterior of the barge in response to the collection of material in the tank, whereby the draft of the barge is essentially constant as floating material is stored in the tank, the draft of the barge corresponding to a given depth of immersion of the recovery opening.

* * * * *

UNITED STATES PATENT AND TRADEMARK OFFICE

CERTIFICATE OF CORRECTION

PATENT NO. : 4,264,444

DATED : April 28, 1981

INVENTOR(S) : Jean A. L. BRONNEC

It is certified that error appears in the above—identified patent and that said Letters Patent is hereby corrected as shown below:

In the identification of the Assignee, "Ateliers" should be --Etablissements--.

In the Abstract, line 9, before "sweep", --to-- should be inserted.

Column 4, line 57, "h." should be --h.--.

Column 5, line 30, "chose" should be --chosen--.

Signed and Sealed this

*Fourth* Day of *August 1981*

[SEAL]

*Attest:*

GERALD J. MOSSINGHOFF

*Attesting Officer*

*Commissioner of Patents and Trademarks*